United States Patent [19]

Schaeff

[11] Patent Number: 5,054,990

[45] Date of Patent: Oct. 8, 1991

[54] EXCAVATOR ARM

[75] Inventor: Hans Schaeff, Langenburg, Fed. Rep. of Germany

[73] Assignee: Karl Schaeff GmbH & Co., Langenburg, Fed. Rep. of Germany

[21] Appl. No.: 450,307

[22] Filed: Dec. 18, 1989

[30] Foreign Application Priority Data

Dec. 24, 1988 [DE] Fed. Rep. of Germany ..... 3843753

[51] Int. Cl.[5] ..... E02F 3/32

[52] U.S. Cl. ..... 414/694; 212/247; 414/722

[58] Field of Search ..... 414/722, 723, 694; 248/664; 212/245, 247; 280/764.1, 765.1

[56] References Cited

U.S. PATENT DOCUMENTS

| | | | |
|---|---|---|---|
| 3,149,737 | 9/1964 | Guinot | 414/694 |
| 3,283,928 | 11/1966 | Bosredon | 414/694 |
| 3,313,431 | 4/1967 | Kelly | 414/694 |
| 3,463,336 | 8/1969 | Mork | 414/694 |
| 4,029,225 | 6/1977 | Wirt | 414/694 |
| 4,394,913 | 7/1983 | Lanning et al. | 280/764.1 X |
| 4,797,060 | 1/1989 | Kishi et al. | 414/694 X |

FOREIGN PATENT DOCUMENTS 3234019 3/1984 Fed. Rep. of Germany .

*Primary Examiner*—Robert J. Spar
*Assistant Examiner*—Donald W. Underwood
*Attorney, Agent, or Firm*—Shlesinger Arkwright & Garvey

[57] ABSTRACT

An excavator arm with basic boom 12, intermediate boom 14 and shovel stem 16 with digging implement is connected to a support part 86 which can be driven directly or indirectly into rotation about a vertical axis 84. In order to dig trenches with vertical walls outside the longitudinal axis of the vehicle and to achieve an advantageous transport position, the intermediate boom 14 consists of a front part 14*a,* a rear part 14*b* and a common rotary joint 20, the most advantageous transport position being achieved by rotating by 180° the front part 14*a,* about the axis of rotation 22 set vertically, from the extended operational position relative to the rear part 14*b.*

11 Claims, 9 Drawing Sheets

EXCAVATOR ARM

Figure 1:
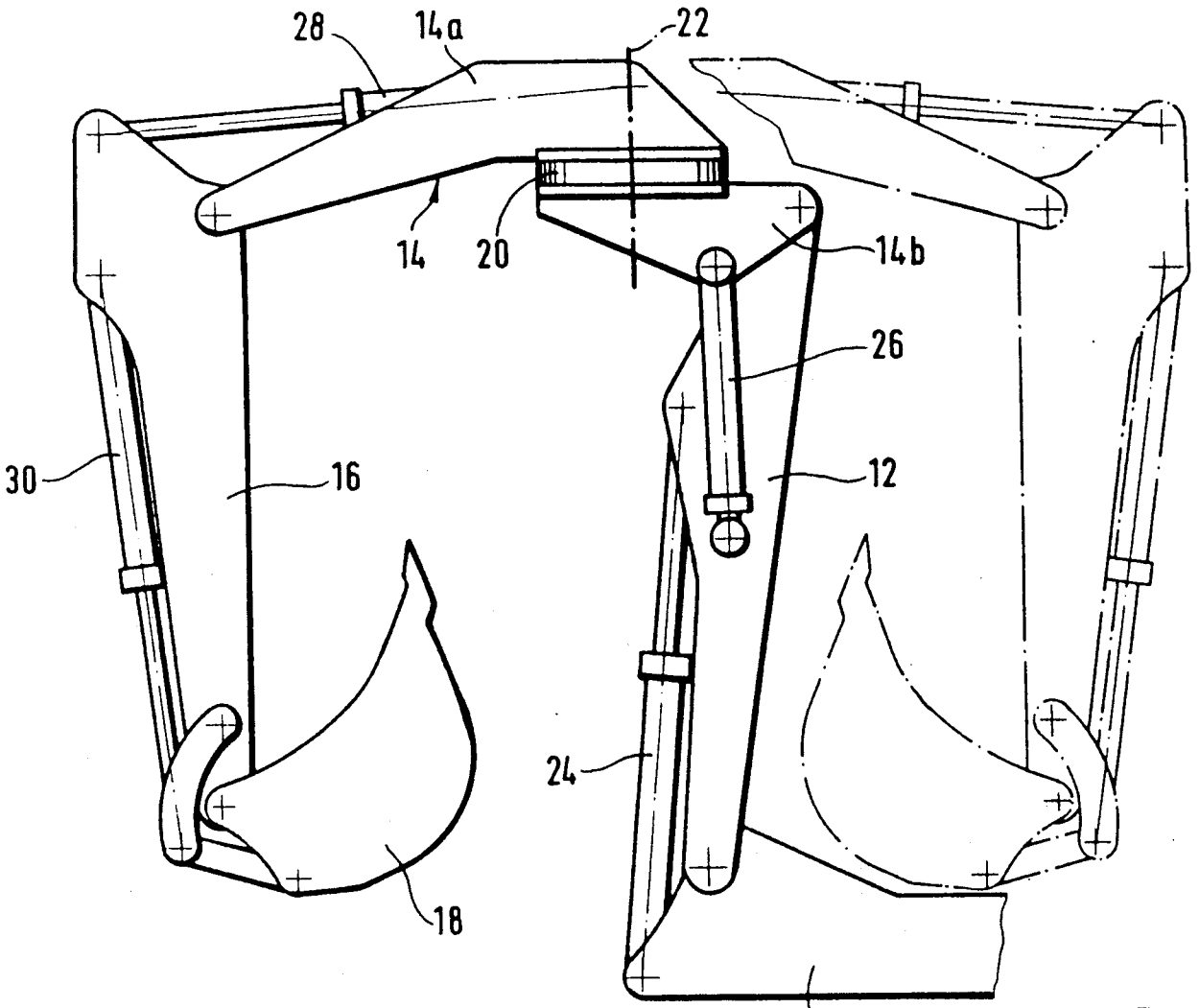

The invention concerns a three-part excavator arm consisting of a basic boom, an intermediate boom and a shovel stem and connected by the basic boom to an excavator base which can be rotated directly or indirectly about a vertical axis, the intermediate boom consisting of a front part, a rear part and a common rotary joint of which the axis of rotation is vertically adjustable.

The digging equipment herein denoted in simplified manner as "excavator arm" and present in known track or wheel excavators or also backhoe loaders as a rule consists of an integral single boom or of a boom in two parts (composed of basic boom and intermediate boom), further of a shovel stem and an excavating implement. In backhoes the basic boom is connected to a mounted holder bilaterally pivotable about a vertical axis at the rear frame.

Designs are known, wherein the excavator arm can be fully rotated by 360°, and this in addition to the conventional rotatability of the revolving superstructure of a mobile excavator. Moreover designs are known wherein the intermediate boom can be partly rotated in various planes, and lastly it is known to rotate the shovel stem partly or totally about itself.

Such an excavator arm is known from the German Auslegeschrift 32 34 019, of which the intermediate boom consists of a front part, a rear part and a common rotary joint, the axis of rotation extending in the vertical pivot plane of the intermediate-boom/rear-part. The basic boom rests on a horizontal pivot shaft on an excavator base which in turn is mounted on the excavator's revolving superstructure endlessly rotatable about a vertical axis. If as regards this excavator arm the rotary joint axis is kept vertical, then it shall be possible to dig trenches with vertical walls and of selected depths parallel to the direction of motion of the excavator.

The object of the invention is to improve an excavator arm of the initially cited kind in such a manner that it can be made to advantageously collapse when moving the excavator from one place to another, whereby the vehicle contour shall be kept low and the excavator shall not project beyond the fixed structures of the vehicle transporting it.

This problem is solved by the invention in that the common rotary joint is designed especially for an endless relative rotation of the front and rear parts, in that the front and rear parts are axially offset relative to each other along the axis of rotation of the rotary joint, and in that the front and rear parts can be locked in place when mutually extended, when in positions pointing in the same direction from the rotary joint, and also when in intermediate positions.

In this design, it is possible to pivot the intermediate boom, when extended as a whole, relative to the basic boom; because consisting of two parts joined by a common rotary joint and mutually endlessly or finitely rotatable about a generally vertical axis, bending the intermediate boom allows digging trenches with vertical walls outside the longitudinal axis of the vehicle by means of the excavator arms. For that purpose either the excavator revolving superstructure shall be adjusted by an angle of rotation corresponding to the bending angle of opposite direction until the front part of the intermediate boom shall be parallel to the longitudinal axis of the vehicle, or the revolving superstructure is replaced by a holder rotatable about a vertical axis and mounted to the excavator vehicle and connected to the basic boom. It is possible to rotate arbitrarily the shovel stem if the rotary joint axis is other than vertical.

In addition to these advantages concerning digging, the special design of the two-part intermediate boom makes it possible at low construction-cost to achieve advantageous, space-saving positions when shipping the excavator or moving it over roads. In order to move the excavator arm of a rear excavator into its transport position, the carriage on which the mounted holder supporting the basic boom pivots about a vertical axis and which is horizontally guided at the rear frame conventionally has been moved into a final side position and thereupon the mounted holder has been pivoted until coming to rest against the rear frame to prevent the collapsed excavator arm from projecting beyond the predetermined excavator contours. The excavator arm of the invention however renders superfluous a displaceable carriage because it collapses the extended intermediate boom, i.e. by pivoting the front part from a central position at the rear frame by about 180° until being over the rear part to arrive at the space-saving transport position remaining within the vehicle contours.

Similar advantages are provided by applying the invention to a mobile excavator with revolving superstructure to which the excavator shovel is rigidly joined and where the excavator arm arrives, by pivoting back the front part from the operational position of the extended intermediate boom by about 150°, into a remaining free space next to the lateral driver cab into a position for transport allowing a clear view of the road.

Appropriately the length of the front part of the intermediate boom is larger than that of the lower part mounted underneath, so that, on account of the rotary joint, the excavating implement together with the downward shovel shaft and the basic boom set upright can be pivoted about the basic boom endlessly or as required into the space-saving transport position.

In an additional feature, the front part of the intermediate boom may taper downward and as a result may contribute to a lesser overall height in the transport position.

In one embodiment the rotary joint may be mounted approximately in the rear third of the intermediate boom whereby the front part is about twice as long as the rear part and provides space underneath for compact collapsing.

In yet another embodiment mode of the excavating arm of the invention, the front part of the intermediate boom is shorter than the rear part, whereby the rotary joint may be located approximately in the front third of the total length of the intermediate boom. In this variation the front part is shortened relative to the rear part of the intermediate boom so much that this front part together with the downward shovel stem and the excavating implement can be rotated endlessly underneath the rear part adjusted approximately horizontally.

In a preferred design, the rotary joint between the front and rear parts consists of a rotary crown, a servo-driven index bolt being provided to more easily find certain angular positions and to lock the rotary joint. A brake or a torque motor with automatic brake may be provided additionally or also alternatively to lock the rotary joint.

In yet another embodiment mode of the invention the pivot axis of the rotary joint may be kept automatically vertical for instance using a parallelogram linkage corresponding to the basic boom whereby in this case all laterally offset or transverse excavations evince vertical sidewalls and moreover the excavator arm shall automatically achieve the space-saving transport position. The drive links of the parallelograms may be replaced by hydraulic jacks which in their retracted or extended end positions shall be of the same length as the basic boom and form with it a parallelogram.

Further features and advantages shall appear in the description below of illustrative embodiments of the drawings showing details of the invention, and from the claims. The features of the claims may embody further embodiments of the invention whether considered alone or in arbitrary combinations.

Figure 1A:
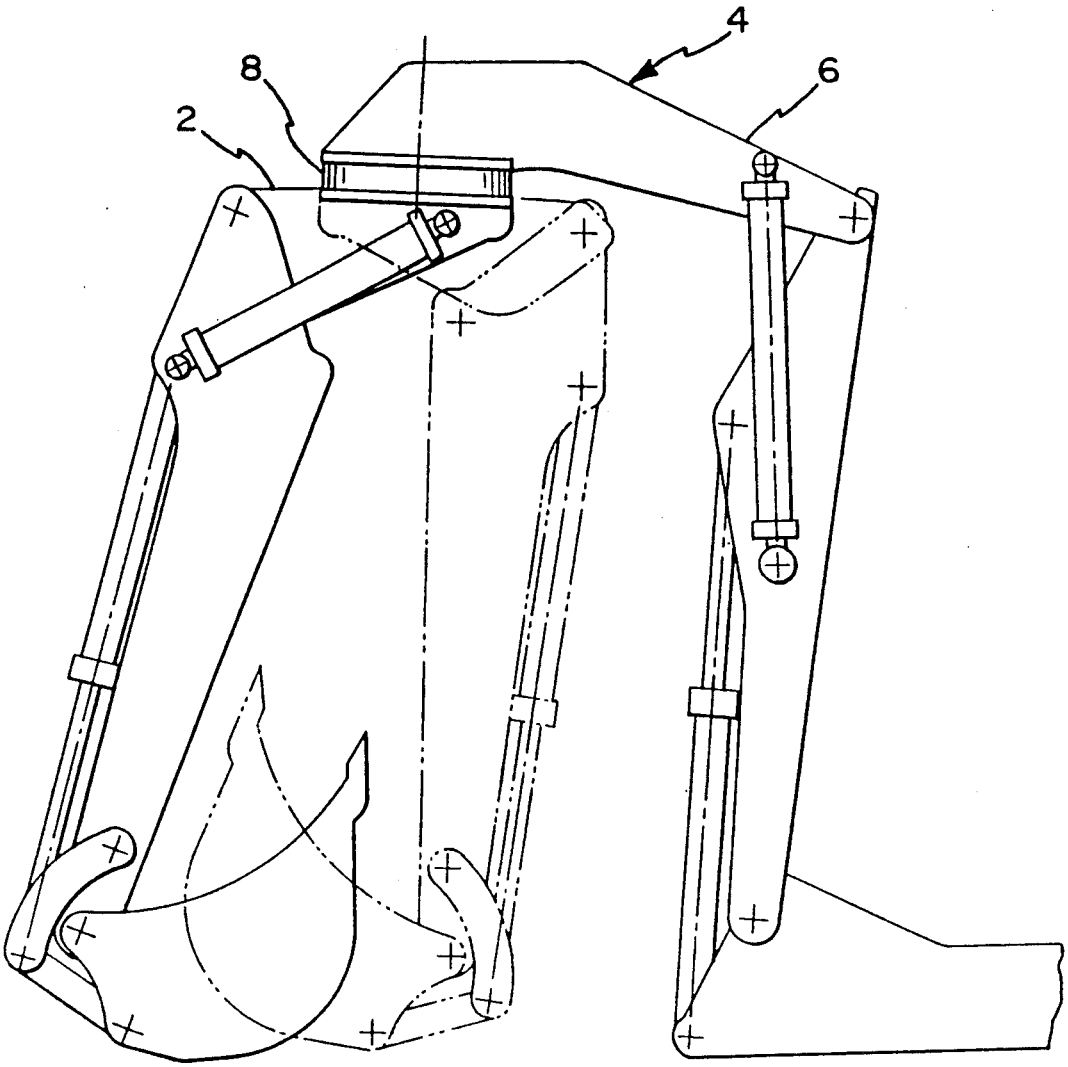

FIG. 1 shows a three-part excavator arm of the invention connected to a base and in the operational position, further in the space-saving transport position indicated by the broken lines, FIG. 1*a* shows another embodiment of the three part excavator arm having a front section shorter than the rear section and mounted below the rear section, the broken lines showing the space saving transport position.

Figure 2:
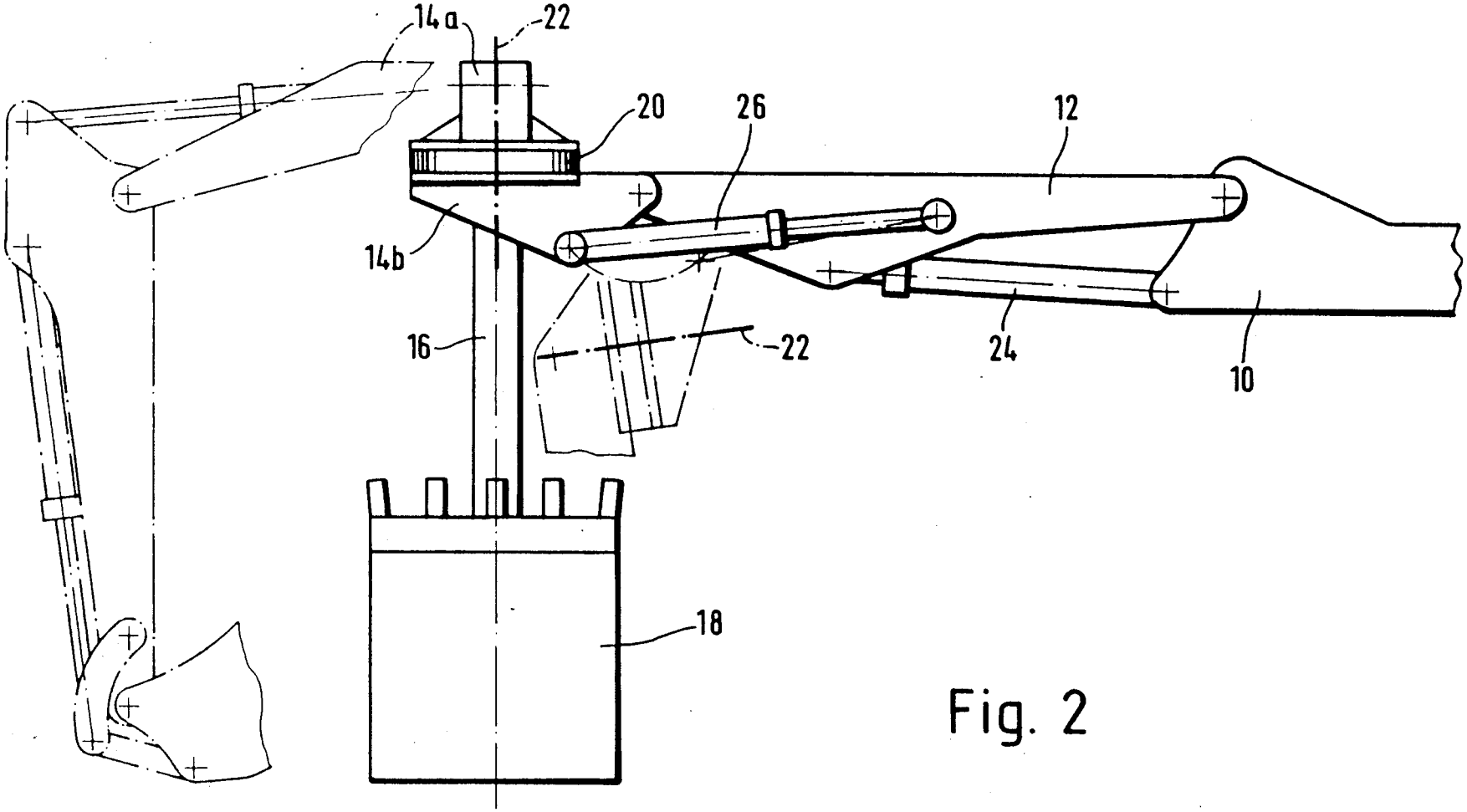
Figure 3:
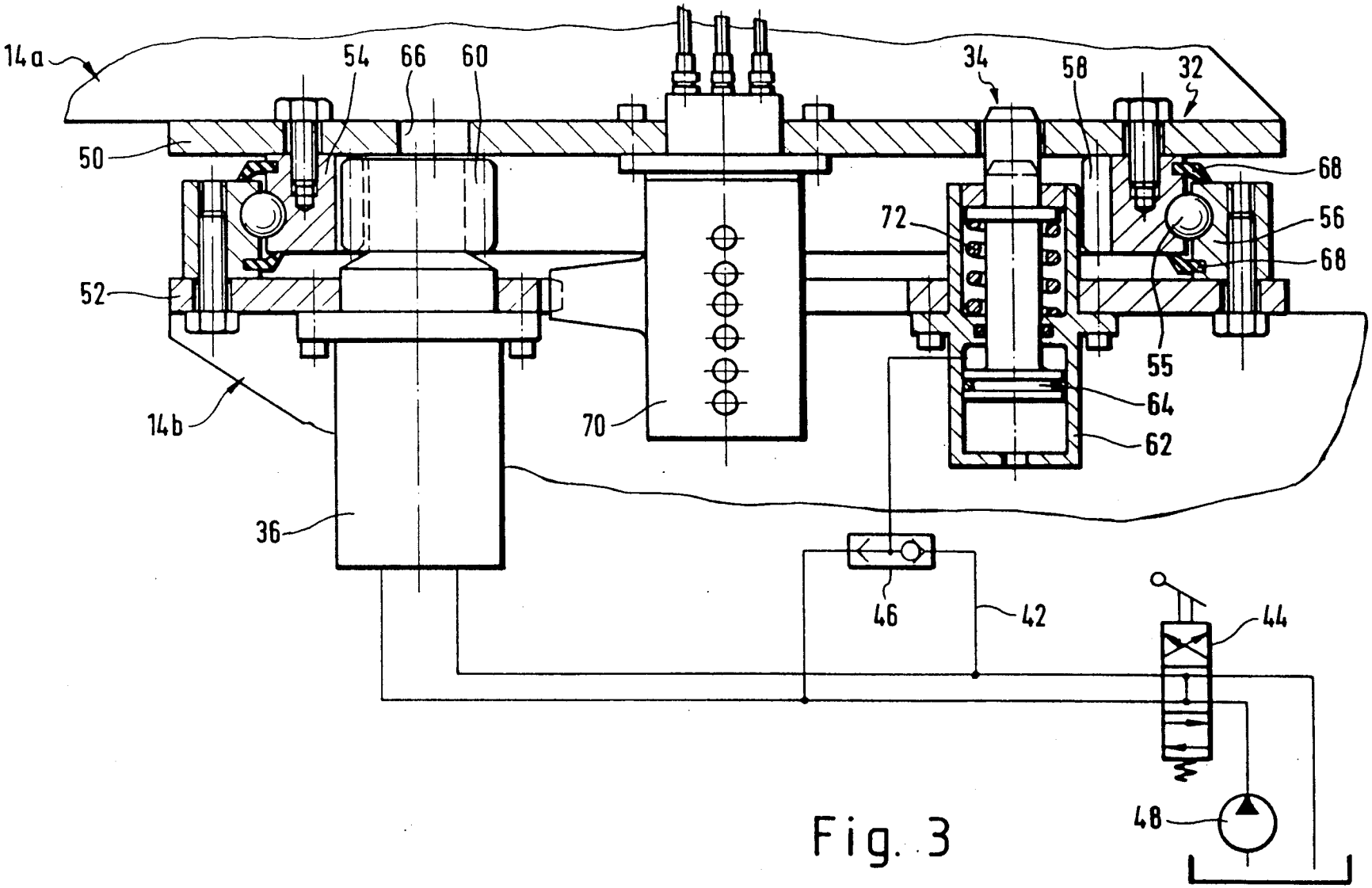
Figure 4:
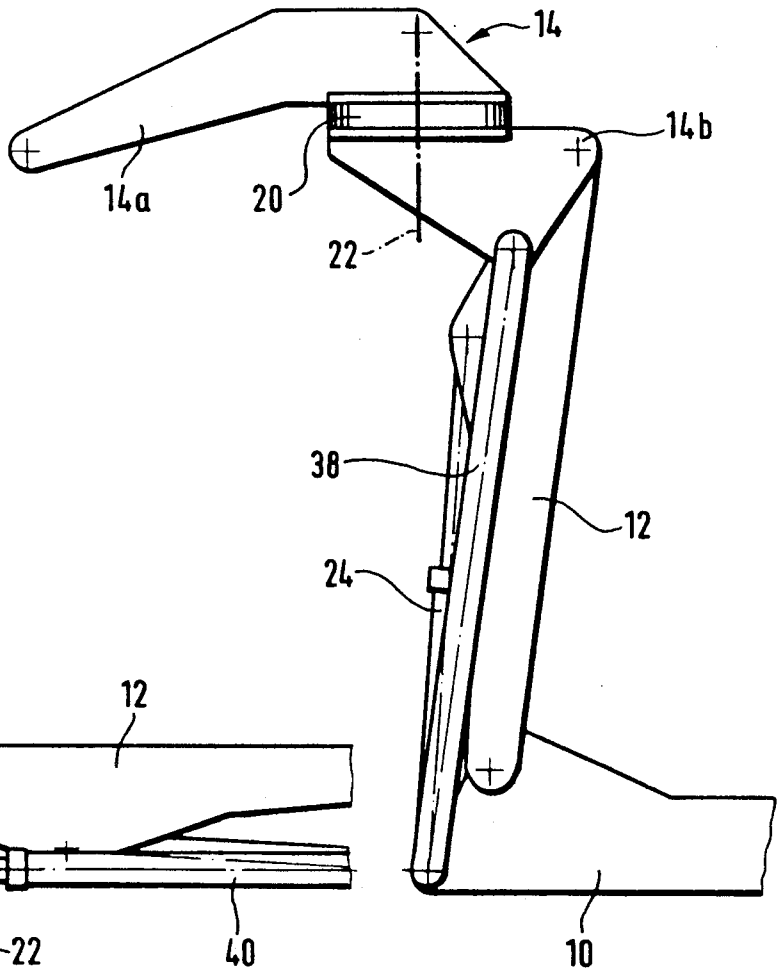
Figure 4A:
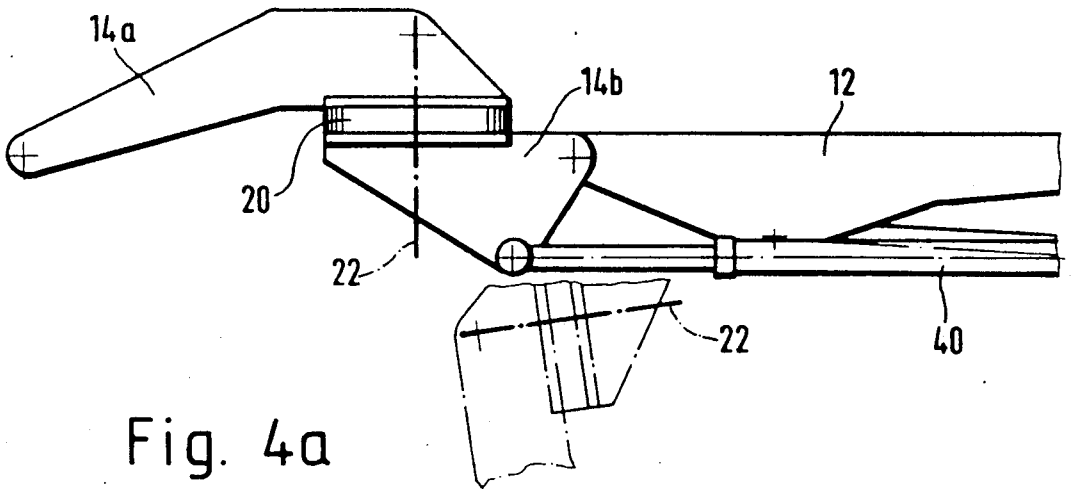
Figure 5:
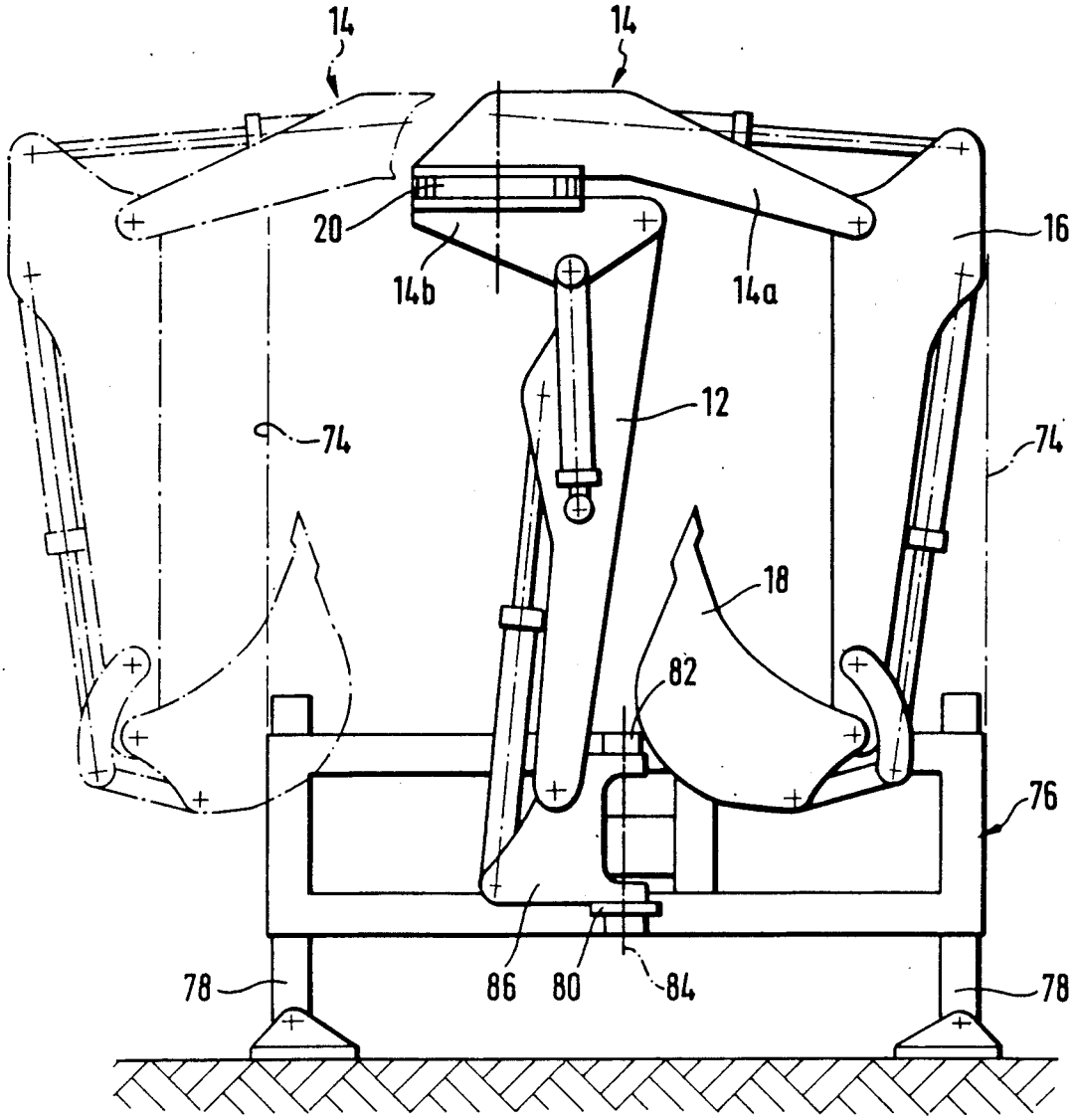
Figure 5A:
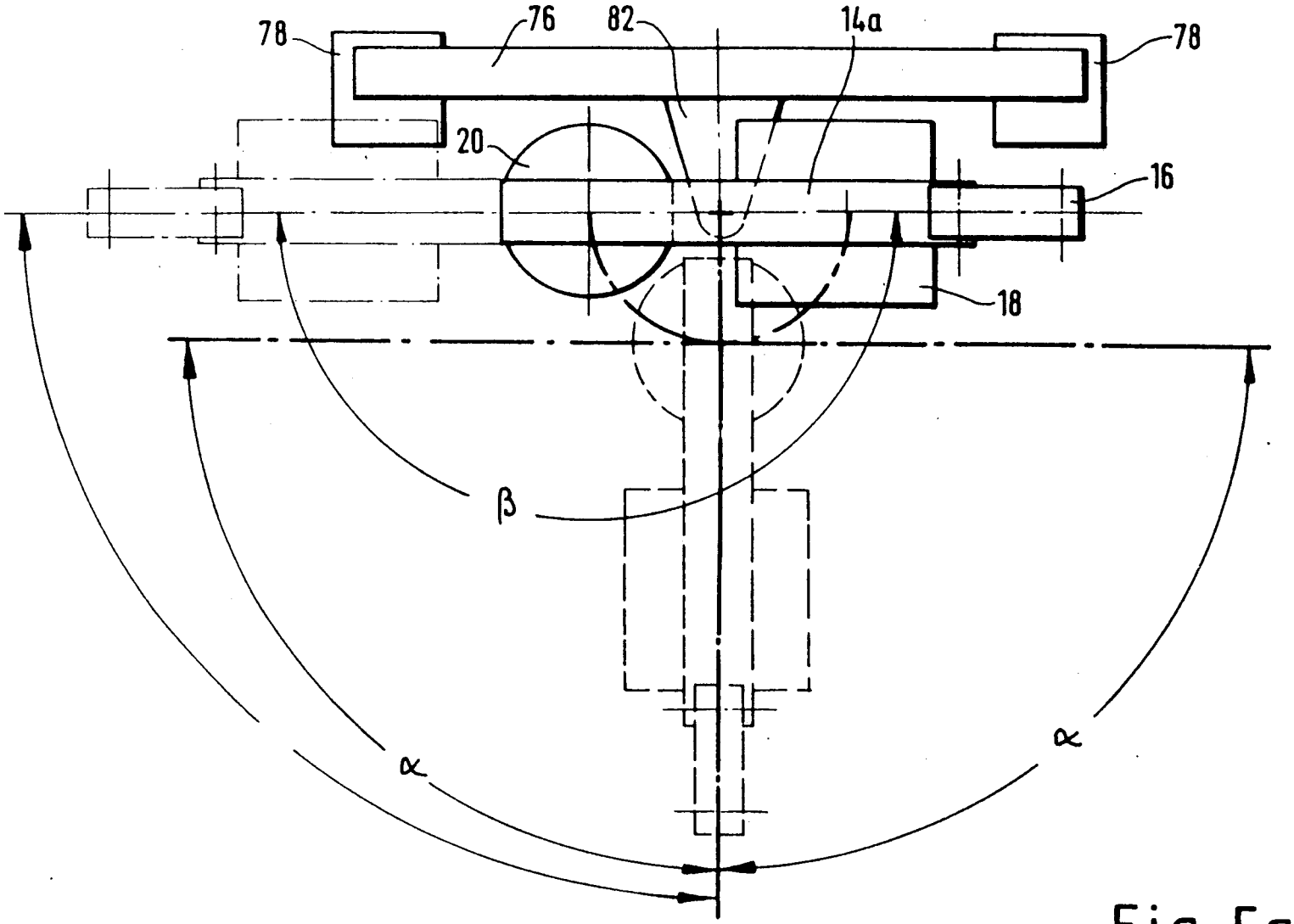
Figure 6:
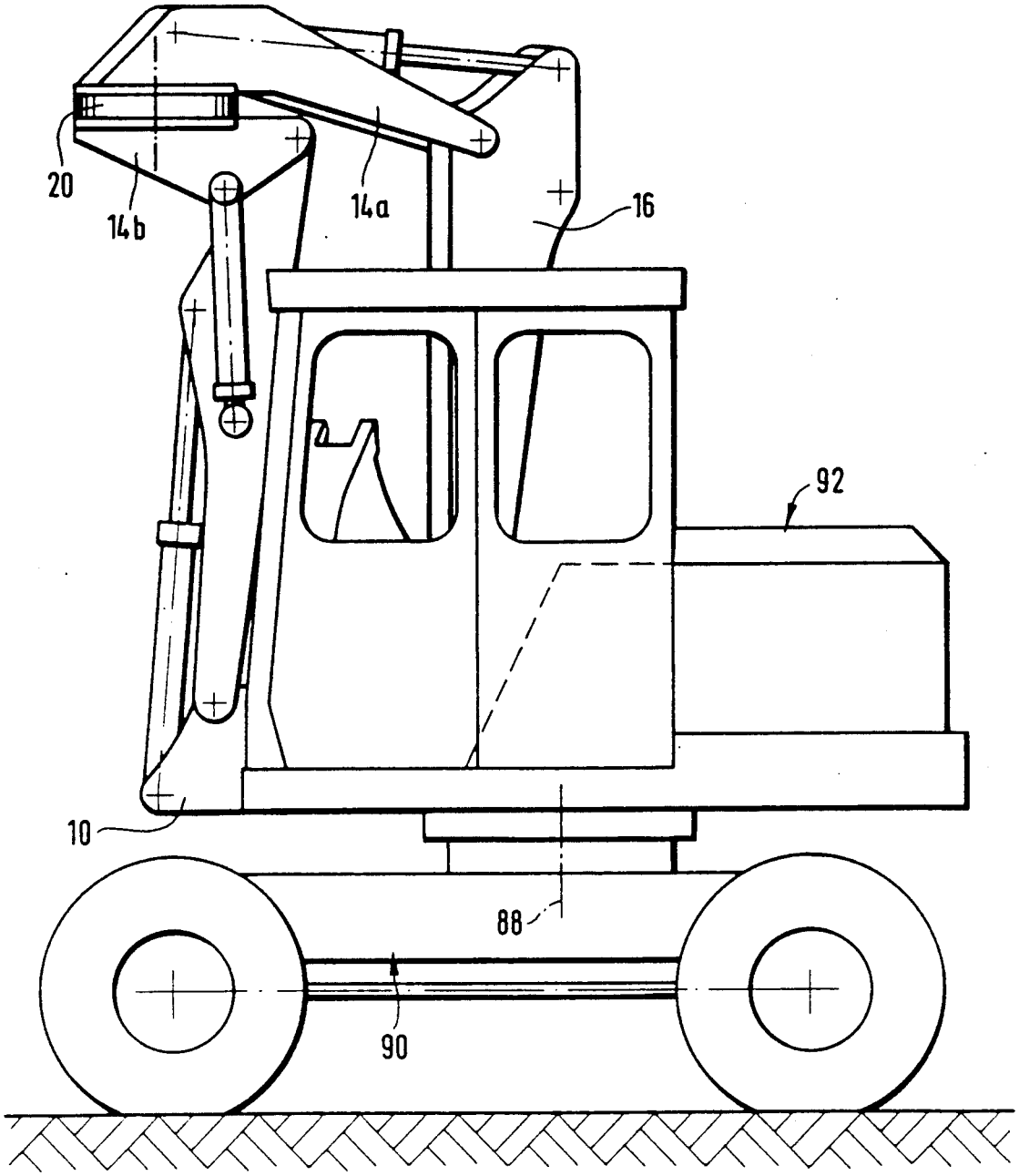
Figure 7:
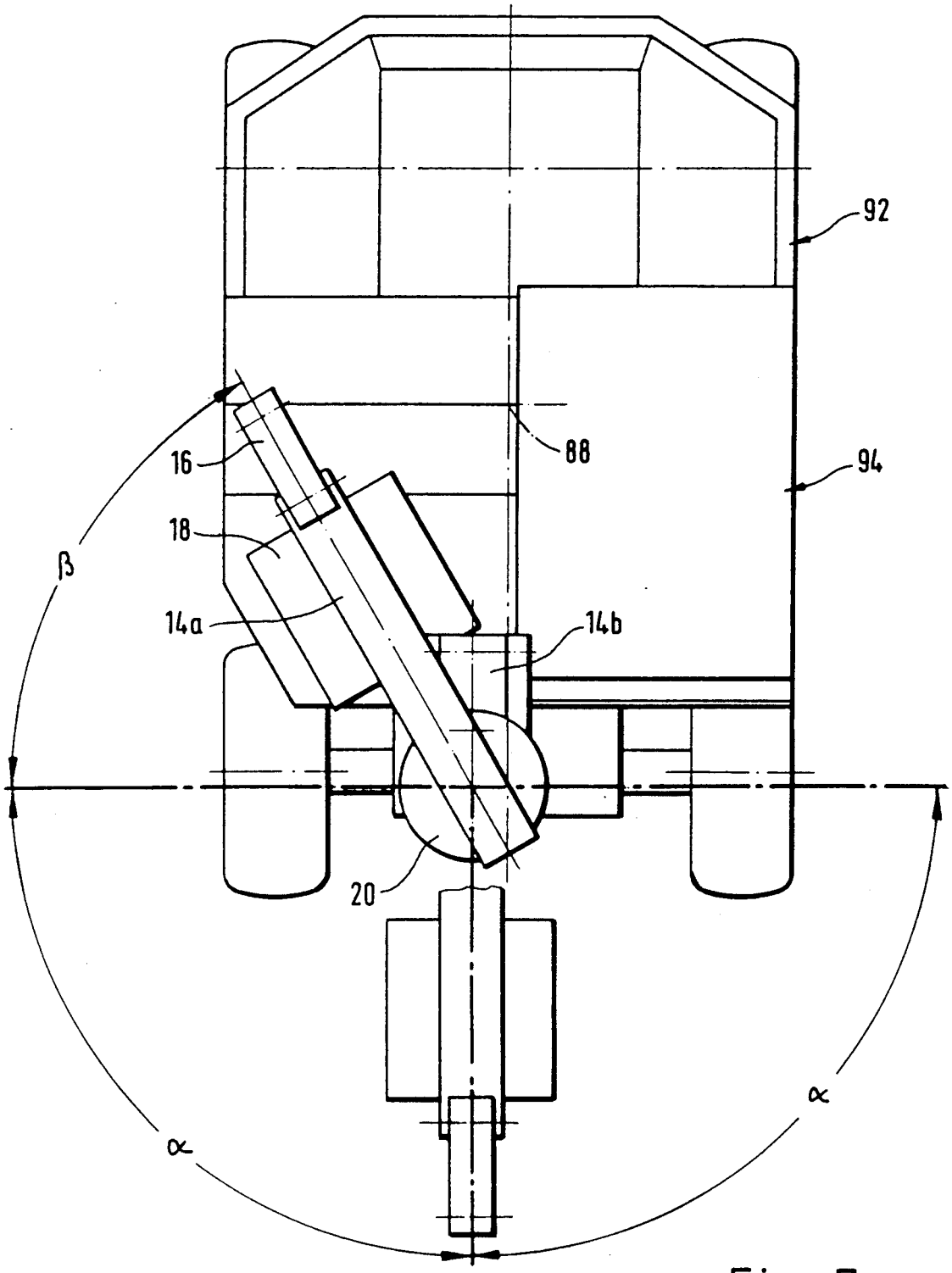

FIG. 2 shows the excavator arm in an operational position with a horizontal basic boom and with an intermediate boom bent away by 90°, the broken lines showing the excavating arm when extended, FIG. 3 shows in longitudinal section and on a larger scale a rotational link between the front and the rear parts of the intermediate boom and a schematic, hydraulic circuit, FIG. 4 shows an excavator arm wherein the drive jack for the intermediate boom is replaced by a parallelogram drive link, FIG. 4*a* shows the excavator arm of FIG. 4 when the basic boom is horizontal and comprising a hydraulic jack operating as a parallelogram drive for the intermediate boom, FIG. 5 is the elevation of a backhoe with the excavator arm in the transport position, FIG. 5*a* is a topview of the arrangement of FIG. 5, FIG. 6 is a sideview of a wheel-mounted excavator with an excavator arm swung back in the transport position, and FIG. 7 is a topview of the wheel-mounted excavator of FIG. 6.

As shown in FIG. 1, an excavator arm is connected in articulating manner by its basic boom 12 to a schematically indicated excavator base 10 which may be rigidly mounted to the revolving superstructure of a mobile excavator similarly to the case shown in FIG. 6. The basic boom 12 hinging on the base 10 can be pivoted vertically by means of jacks 24.

An intermediate boom 14 articulates on the front end of the basic boom 12 and comprises a front part 14*a*, a rear part 14*b* and a common rotary joint 20, the axis of rotation 22 being in or parallel to the vertical plane of rotation of the basic boom 12 and the rear part 14*b*. A shovel stem 16 for a shovel 18 or another excavating implement rotary joints on the front part 14*a* of the intermediate boom 14 and can be pivoted by means of a jack 28 resting on this intermediate boom, a drive jack 30 being provided at the shovel stem for the operational motions of the excavating implement 18.

The extended length of the intermediate boom 14 taken up in ordinary operation is shown by solid lines in FIG. 1 whereas the space-saving transport position with retained erect basic boom 12 is shown in broken lines, in latter case the front part 14*a* being rotated by about 180° about the axis 22 of the rotary joint relative to the extended position. In the conditions shown, wherein front and rear parts overlap, the intermediate boom 14 is in its shortest state which can be used for the space-saving transport position of the excavating arm if illustratively mounted next to the driver cabin of a work vehicle.

In yet another embodiment of the excavating arm shown in FIG. 1*a*, the front part 2 of the intermediate boom 4 is shorter than the rear part 6 whereby the rotary joint 8, may be located in approximately the front third of the total length of the intermediate boom 4.

FIG. 2 shows the intermediate boom being driven by the hydraulic jack 26 into its extended state with a horizontally pivoted basic boom 12, the front part 14*a* being rotated by 90 from the plane of the drawing to the rear. As long as the axis of rotation 22 is set vertically, the excavator shovel 18 can be made to produce vertical walls or can pick up or deposit loads laterally. The left side of the FIG. 2 shows in broken lines the state of the excavator arm when the intermediate boom is extended. The extensive pivotability and operational capability of this excavator arm furthermore are shown by the inclined end position of the rear part 14*b*, indicated in broken lines, inclusive the then correspondingly slanting axis of rotation 22.

A rotary joint in the form of a rotary crown 32 is formed as shown in FIG. 3 between the front and the rear parts of the intermediate boom 14 and between the mutually opposite connection surfaces 50, 52 resp. at the front part 14*a* and at the rear part 14*b* by mounting a bearing ring 54 to the upper connecting surface 50 and a bearing ring 56 to the lower bearing surface 52, said bearing rings being linked by balls or similar rolling bodies 55. The bearing rings 54, 56 are fixed by bolts to the bearing surfaces and are sealed relative to each other by means of sealing sleeves 68. The upper bearing ring 54 comprises an inside toothing 58 engaged by a pinion 60 of the hydraulic rotary motor 36 in order to rotate the front part 14*a* or the rear part 14*b* of the intermediate boom.

A rotary feedthrough 70 for the hydraulic supply to the jacks 28 and 30 is provided at the upper connection surface 50 and passes through an aperture in the lower connection surface 52. The rotary motor 36 and a drive jack 62 for an indexing bolt 34 are affixed to the lower connection surface. A plunger 64 connected to the indexing bolt 34 is displaceable inside the jack 62. The indexing bolt 34 is prestressed by means of a spring 72 into the locked position shown in solid lines, and it shall be retracted from that position by means of the hydraulics against the spring force when the front part 14*a* of the intermediate boom must be rotated.

A series (omitted from the drawings) of positioning openings 66 in the upper connection surface 50 is associated with the indexing bolt 34. Upon actuation of the rotary motor 36 into either direction by the parallel circuit 42, the hydraulic circuit assures that first the jack 62 shall be supplied with pressurized means in order to retract the indexing bolt and to release the connection surface 50 so it can be rotated. Depending on the switching position of the control apparatus 44, the pump 48 applies compression means from either side to the shuttle valve 46 in the parallel circuit 42.

FIGS. 4 and 4*a* show the excavator arm in similar operational positions as in FIGS. 1 and 2 except that the jack 26 of the intermediate boom has been replaced by the guide bar 38 parallel to the basic boom 12 and affixed to the base 10. When the jack 24 is actuated and the basic boom is pivoted, the rear part 14*b* of the intermediate boo shall always be guided parallel therefore, and accordingly even in the position shown in FIG. 4*a*, the axis of rotation 22 shall still be kept vertical by said rear part 14*b*.

FIG. 4*a* indicates a variation in that the guide bar 38 from FIG. 4 and which may be present dually in a symmetrical design is replaced by a hydraulic jack 40. In its extended position the jack 40 then shall act in the manner of the guide stem 38, being of the same length. The resulting position of the axis of rotation 22 when the jack 40 has been retracted is indicated by broken lines in FIG. 4*a*.

FIGS. 5 and 5*a* show a practical embodiment mode for an excavator arm collapsible into a narrow space, illustratively a rear frame 76 which can be mounted to a vehicle being the carrier of an excavator arm of the invention. A vertical pivot shaft 84 on bearing fittings 80, 82 and for a mounted holder 86 is provided at the center of the rear frame 76 equipped with telescoping supports 78, said mounted holder 86 bearing in articulating manner and similarly to an excavator base the lower end of the basic boom 12 and of the associated pivot jack. The mounted holder 86 together with the excavator arm can be pivoted from the straight-forward position indicated in FIG. 5*a* and coinciding with the longitudinal axis of the vehicle toward both sides for particular operations and in each case by $=90°$ or more. In each pivoted position of the mounted holder 86, the front part 14*a* of the intermediate boom and hence also the shovel stem and the excavating shovel can be set parallel by means of the rotary joint 20 parallel to the longitudinal axis of the vehicle.

In order to achieve the advantageous transport position wherein the collapsed excavating arm remains within the lateral boundary lines 74 of the vehicle contour, the front part 14*a* of the intermediate boom 14 shown extending to the left in FIG. 5 is pivoted back by $\beta=180°$, whereby the length of the intermediate boom 40 is substantially reduced and so that as shown in FIG. 5 both the mounted holder bracket 86 and the rear part 14*b* point left whereas the front part 14*a* keeps the shovel stem 16 with the excavating shovel 18 within the overall vehicle contours The vertical axis of rotation 84 remains centrally at the rear frame 76.

FIGS. 6 and 7 illustrate the use of the excavator arm together with an excavator base 10 which is part of a revolving superstructure 92 rotatable about a vertical axis 88 on the vehicle frame 90 of a mobile excavator. The base 10 is rigidly affixed to the superstructure 92 set in the direction of travel and projects forward into the preferred main excavator position indicated in FIG. 7. Together with the superstructure 92, the excavator arm can be pivoted endlessly about the vertical axis 88, the front part 14*a* of the intermediate boom 14 together with the shovel stem and excavating implement being adjustable for any superstructure position arbitrarily parallel to the longitudinal direction of the vehicle or in some other manner. The preferred transport position is achieved as shown in FIG. 7 for an oblique position of the excavating arm because the total angle of rotation of the front part 14*a* from the extended state of the intermediate boom into its transport position is about 150°, the excavating arm being laterally braked and locked next to the driver cab 94 and remaining then within the lateral vehicle boundaries. The downward bent of the fore section of the front part 14*a* achieves the least overall height of the excavating arm in the transport position.

I claim:

1. A three-part excavator arm, comprising:

a) a basic boom, an intermediate boom, and a shovel stem pivotally connected to each other about horizontal pivot axes and pivotally connected by said basic boom to an excavator base, which is rotatable about a vertical axis;

b) said intermediate boom having a front part, a rear part, and a common rotary joint having an axis of rotation;

c) actuating means for operating and adjusting said axis of rotation into vertical orientation;

d) said common rotary joint allows mutual endless rotation between the front part and the rear part of said intermediate boom;

e) said front part and said rear part being axially offset along the axis of rotation of said rotary joint to afford unrestricted relative rotational movement between both of said parts; and, f) locking means for locking said front part and said rear part at mutually straightened positions, at a position pointing in the same direction from the rotary joint and at intermediate positions.

2. The excavator arm as defined in claim 1, wherein:

a) the front part of the intermediate boom is mounted above the rear part, when the rotational axis of the rotary joint extends approximately vertically.

3. The excavator arm as defined in claim 2, wherein:

a) the front part is longer than the rear part and when the basic boom and the axis of rotation are approximately vertical, the shovel stem can be freely rotated about the basic boom when the shovel stem is pointing vertically downwardly.

4. The excavator arm as defined in claim 3, wherein:

a) the front part of the intermediate boom is angled downwardly and thereby does not add any height to the excavator arm when the rotational axis of the common rotary joint is adjusted into vertical orientation.

5. The excavator arm as defined in claim 4, wherein:

a) the rotary joint is disposed approximately in the rear third of the intermediate boom.

6. The excavator arm as defined in claim 1, wherein:

a) the front part of the intermediate boom is shorter than the rear part; and, b) the common rotary joint is disposed approximately in the front third of the intermediate boom.

7. The excavator arm as defined in claim 1, wherein:

a) said common rotary joint includes a rotary crown, and a servo-driven indexing bolt is provided for locking the rotary joint into specific angular positions.

8. The excavator arm as defined in claim 7, wherein:

a) said rotary joint includes a rotary motor and an automatic brake means for locking the rotary joint.

9. The excavator arm as defined in claim 7, wherein:

a) said front part and said rear part include opposite connection surfaces;

b) said rotary crown includes cooperating bearing rings mounted to said opposite connection surfaces;

c) a gap is formed between said connection surfaces;

d) a rotary motor having a drive pinion for rotating one of said bearing rings with respect another bearing ring; and, e) a guide associated with said indexing bolt and being mounted within said gap.

10. The excavator arm as defined in claim 1, wherein:

a) the rear part of the intermediate boom is kept in a preferred position by at least one link extending parallel to the basic boom; and, b) the preferred position of said axis of rotation in general being vertical.

11. The excavator arm as defined in claim 10, wherein:

a) said link includes a hydraulic jack which is movable to a position in which its length equals the length of the basic boom.

* * * * *